US011220909B2

(12) United States Patent
Takata et al.

(10) Patent No.: US 11,220,909 B2
(45) Date of Patent: Jan. 11, 2022

(54) TURBINE ROTOR BLADE ROW, TURBINE STAGE, AND AXIAL-FLOW TURBINE

(71) Applicant: MITSUBISHI HEAVY INDUSTRIES, LTD., Tokyo (JP)

(72) Inventors: Ryo Takata, Tokyo (JP); Keiichi Meguro, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 1021 days.

(21) Appl. No.: 15/313,857

(22) PCT Filed: Feb. 10, 2015

(86) PCT No.: PCT/JP2015/053677
§ 371 (c)(1),
(2) Date: Nov. 23, 2016

(87) PCT Pub. No.: WO2015/198622
PCT Pub. Date: Dec. 30, 2015

(65) Prior Publication Data

US 2017/0204728 A1 Jul. 20, 2017

(30) Foreign Application Priority Data

Jun. 26, 2014 (JP) ..... JP2014-131442

(51) Int. Cl.
*F01D 5/06* (2006.01)
*F04D 29/38* (2006.01)
(Continued)

(52) U.S. Cl.
CPC ..... *F01D 5/06* (2013.01); *F01D 5/145* (2013.01); *F01D 9/041* (2013.01); *F04D 19/02* (2013.01);
(Continued)

(58) Field of Classification Search
CPC ... F01D 5/06; F01D 5/14; F01D 5/141; F01D 5/145; F01D 5/142; F04D 29/38;
(Continued)

(56) References Cited

U.S. PATENT DOCUMENTS 907,981 A * 12/1908 Ferranti ..... F01D 5/225 415/173.6
995,367 A * 6/1911 Patitz ..... F01D 5/06 416/201 R
(Continued)

FOREIGN PATENT DOCUMENTS

DE 10 2011 083 778 A1 4/2013
EP 1 712 737 A1 10/2006
(Continued)

OTHER PUBLICATIONS

Critical Mach number—Wikipedia, the free encyclopedia (Year: 2013).*
(Continued)

*Primary Examiner* — Christopher Verdier
*Assistant Examiner* — Elton K Wong
(74) *Attorney, Agent, or Firm* — Westerman, Hattori, Daniels & Adrian, LLP

(57) ABSTRACT

A turbine rotor blade row includes: a plurality of turbine rotor blades disposed along a circumferential direction of a hub. An inter-blade flow channel has a first cross-sectional shape perpendicular to a radial direction of the hub at a first position in the radial direction, and a second cross-sectional shape perpendicular to the radial direction of the hub at a second position farther from the hub than the first position in the radial direction. The first cross-sectional shape has a throat portion between an inlet and an outlet of the inter-blade flow channel in an axial direction of the hub.

13 Claims, 10 Drawing Sheets

(51) Int. Cl.
*F04D 19/02* (2006.01)
*F01D 5/14* (2006.01)
*F01D 9/04* (2006.01)

(52) U.S. Cl.
CPC ..... *F04D 29/38* (2013.01); *F05D 2220/30* (2013.01); *F05D 2250/30* (2013.01)

(58) Field of Classification Search
CPC ..... F04D 29/384; F05D 2220/32; F05D 2220/31; F05D 2210/31; F05D 2210/30; F05D 2240/305; F05D 2240/306
USPC ..... 416/223 A, 243
See application file for complete search history.

(56) References Cited

U.S. PATENT DOCUMENTS 1,050,119 A * 1/1913 Flanders ..... F01D 5/3023 416/220 R
1,548,613 A * 8/1925 Kieser ..... F01D 5/141 29/889.21
1,673,554 A * 6/1928 Frey ..... F01D 5/14 415/191
1,749,528 A * 3/1930 Frey et al. ..... F01D 5/14 416/248
2,258,793 A * 10/1941 Winston ..... F01D 5/142 415/181
3,347,520 A * 10/1967 Oweczarek ..... F01D 5/14 415/119
3,475,108 A * 10/1969 Zickuhr ..... F01D 5/141 415/194
3,652,182 A * 3/1972 Deich ..... F01D 25/32 415/169.4
4,626,174 A * 12/1986 Sato ..... F01D 5/141 415/181
4,643,645 A 2/1987 Robbins et al.
4,809,498 A * 3/1989 Giffin, III ..... B64C 11/48 416/129
4,968,216 A * 11/1990 Anderson ..... F01D 1/16 415/181
5,203,676 A * 4/1993 Ferleger ..... F01D 5/141 416/191
5,221,181 A * 6/1993 Ferleger ..... F01D 5/141 415/181
5,277,549 A * 1/1994 Chen ..... F01D 5/141 415/181
5,326,221 A * 7/1994 Amyot ..... F01D 5/141 415/181
5,352,092 A * 10/1994 Ferleger ..... F01D 5/141 416/223 A
6,036,438 A * 3/2000 Imai ..... F01D 5/142 415/192
6,431,829 B1 8/2002 Watanabe et al.
6,779,973 B2 * 8/2004 Ito ..... F01D 5/141 415/191
7,048,509 B2 * 5/2006 Tominaga ..... F01D 5/14 416/223 A
7,740,449 B1 * 6/2010 Brown ..... F01D 9/041 415/1
8,167,548 B2 * 5/2012 Greim ..... F01D 5/141 415/193
8,821,107 B2 * 9/2014 Lamarque ..... F01D 3/00 415/1
8,967,959 B2 * 3/2015 Stein ..... F01D 5/141 415/192
9,695,694 B2 * 7/2017 Huebner ..... F01D 5/141
9,719,354 B2 * 8/2017 Kitagawa ..... F01D 5/141
9,957,804 B2 * 5/2018 Chouhan ..... F01D 5/141
9,957,805 B2 * 5/2018 Soni ..... F01D 5/145
9,963,985 B2 * 5/2018 Chouhan ..... F01D 9/041
2003/0086788 A1 * 5/2003 Chandraker ..... F01D 5/141 416/235
2005/0019157 A1 * 1/2005 Tominaga ..... F01D 5/14 415/192
2005/0039333 A1 2/2005 Wechsung
2007/0081898 A1 4/2007 Matsuda et al.
2008/0240924 A1 10/2008 Kizuka et al.
2009/0257866 A1 * 10/2009 Greim ..... F01D 5/141 415/208.1
2014/0248154 A1 9/2014 Guemmer

FOREIGN PATENT DOCUMENTS

GB 868100 A * 5/1961 ..... F01D 5/142
GB 1 489 095 A 10/1977
JP 49-129002 A 12/1974
JP 50-8123 B1 4/1975
JP 62-59203 B2 2/1981
JP 61-31601 A 2/1986
JP 8-218803 A 8/1996
JP 11-173104 A 6/1999
JP 2000-345801 A 12/2000
JP 2003-20904 A 1/2003
JP 2003-184504 A 7/2003
JP 2003-254002 A 9/2003
JP 2005-133697 A 5/2005
JP 2005-315178 A 11/2005
JP 2006-207556 A 8/2006
JP 2007-182776 A 7/2007
JP 2008-215091 A 9/2008
JP 2012-202224 A 10/2012
JP 2014-111941 A 6/2014

OTHER PUBLICATIONS

Office Action dated Jul. 20, 2018, issued in counterpart European Patent application No. 15810938.9. (5 pages).
Office Action dated Feb. 12, 2018, issued in counterpart Korean Application No. 10-2017-7001805, with English translation (8 pages).
Office Action dated Apr. 27, 2018, issued in counterpart Japanese application No. 2014-131442, with English translation. (12 pages).
International Search Report dated May 19, 2015, issued in counterpart International Application No. PCT/JP2015/053677 (2 Pages).
Office Action dated Jul. 28, 2017, issued in counterpart Japanese Application No. 2014-131442, with English translation (18 pages).
Extended (supplementary) European Search Report dated May 18, 2017, issued in counterpart European Patent Application No. 15810938.9. (7 pages).
International Preliminary Report on Patentability (Form PCT/IB/373 issued in counterpart International Application No. PCT/JP2015/053677 dated Jan. 5, 2017, with Form PCT/IB/326, PCT/ISA/237, and PCT/IB/338 (14 pages).

* cited by examiner

TURBINE ROTOR BLADE ROW, TURBINE STAGE, AND AXIAL-FLOW TURBINE

TECHNICAL FIELD

The present disclosure relates to a turbine rotor blade row, a turbine stage, and an axial-flow turbine.

BACKGROUND ART

A turbine such as a steam turbine and a gas turbine includes a plurality of turbine rotor blades disposed along a circumferential direction of a hub, with inter-blade flow channels formed between the turbine rotor blades. A fluid passes through the inter-blade flow channels, and a centrifugal force generated due to the velocity energy of the fluid and a pressure differential between a pressure-surface side and a suction-surface side of a turbine rotor blade are balanced in the vicinity of a mean (intermediate) position of the turbine rotor blade. On the other hand, the flow velocity is low and thus the centrifugal force decreases at a boundary layer of the flow in the vicinity of the hub. Accordingly, a secondary flow (cross flow) of the fluid may be generated, flowing from the pressure-surface side with a high pressure toward the suction-surface side with a low pressure. In typical turbine rotor blades, such a secondary flow generates loss (secondary-flow loss) which accounts significantly for power loss.

Patent Document 1 discloses an axial-flow turbine blade for reducing the secondary-flow loss. This axial-flow turbine blade is formed to have a cross section, from a blade root portion to a blade tip portion, enlarged or reduced so that a ratio s/t of the minimum distance "s" between a trailing-edge end of a nozzle blade and the suction surface of the adjacent nozzle blade to the annular pitch "t" changes in a blade-height direction. Patent Document 1 also discloses that this axial-flow turbine blade can be applied to a turbine rotor blade.

CITATION LIST

Patent Literature

Patent Document 1: JP2003-20904A

SUMMARY

Problems to be Solved

Typical turbine rotor blades are configured such that the width of an inter-blade flow channel gradually narrows from the inlet toward the outlet of the inter-blade flow channel. The axial-flow turbine blade in Patent Document 1 has a similar configuration, even though the flow-channel width of the axial-flow turbine blade is varied in the blade-height direction at the outlet of the inter-blade flow channel.

If the flow-channel width gradually narrows from the inlet toward the outlet of an inter-blade flow channel as in the above-mentioned configuration, separation of a flow could be suppressed to some extent, but a flow is still likely to separate at the upstream side in the inter-blade flow channel and a secondary flow is likely to occur and develop.

In view of the above issue, an object of at least one embodiment of the present invention is to provide a turbine rotor blade row, a turbine stage, and an axial-flow turbine, whereby it is possible to suppress secondary-flow loss to improve performance of a turbine rotor blade row.

Solution to the Problems (1) A turbine rotor blade row according to at least one embodiment of the present invention comprises: a plurality of turbine rotor blades disposed along a circumferential direction of a hub with an inter-blade flow channel formed between the turbine rotor blades. The inter-blade flow channel has a first cross-sectional shape perpendicular to a radial direction of the hub at a first position in the radial direction, and a second cross-sectional shape perpendicular to the radial direction of the hub at a second position farther from the hub than the first position in the radial direction. The first cross-sectional shape has a throat portion between an inlet and an outlet of the inter-blade flow channel in an axial direction of the hub. An expression A1/B1>A2/B2 is satisfied, where A1 is a flow-channel width of the first cross-sectional shape at the outlet of the inter-blade flow channel, B1 is a flow-channel width of the first cross-sectional shape at the throat portion. A2 is a flow-channel width of the second cross-sectional shape at the outlet of the inter-blade flow channel, and B2 is a flow-channel width of the second cross-sectional shape at the same position as the throat portion in the axial direction of the hub.

With the turbine rotor blade row having the above configuration (1), the first cross-sectional shape has a throat portion between the inlet and the outlet of the inter-blade flow channel in the axial direction of the hub, and thus the flow has a higher velocity at the inlet side of the throat portion, which makes it possible to suppress occurrence of separation at the inlet side of the throat portion. If such a throat portion is simply provided without any conditions, the velocity may decrease in the flow channel at the outlet side of the throat portion, which makes it difficult to suppress secondary-flow loss. However, with the above turbine rotor blade row (1), the condition A1/B1>A2/B2 is satisfied as well, and thus it is possible to form a pressure gradient in the radial direction of the hub that suppresses uplift of the secondary flow from the surface of the hub flowing outward in the radial direction of the hub, between the inlet and the outlet of the inter-blade flow channel. Accordingly, it is possible to reduce secondary-flow loss effectively, and improve the performance of the turbine rotor blade row.

(2) In some embodiments, in the above turbine rotor blade row (1), the flow-channel width of the second cross-sectional shape monotonically decreases from the inlet toward the outlet of the inter-blade flow channel.

With the above turbine rotor blade row (2), it is possible to readily form a pressure gradient in the radial direction of the hub that suppresses uplift of the secondary flow from the surface of the hub flowing outward in the radial direction of the hub, between the inlet and the outlet of the inter-blade flow channel. Accordingly, it is possible to reduce secondary-flow loss effectively, and improve the performance of the turbine rotor blade row.

(3) In some embodiments, in the above turbine rotor blade row (1), the second cross-sectional shape includes a throat portion between the inlet and the outlet of the inter-blade flow channel.

With the above turbine rotor blade row (3), also in a case each of the first cross-sectional shape and the second cross-sectional shape has a throat portion, uplift of the secondary flow flowing outward in the radial direction from the surface of the hub is suppressed by satisfying the above condition (A1/B1>A2/B2).

(4) In some embodiments, in the above turbine rotor blade row (3), the throat portion of the second cross-sectional shape is disposed closer to the outlet of the inter-blade flow channel in the axial direction of the hub than the throat portion of the first cross-sectional shape is.

With the above turbine rotor blade row (4), even in a case where each of the first cross-sectional shape and the second cross-sectional shape has a throat portion, it is possible to readily form a pressure gradient in the radial direction of the hub that suppresses uplift of the secondary flow from the surface of the hub flowing outward in the radial direction of the hub, between the inlet and the outlet of the inter-blade flow channel. Accordingly, it is possible to reduce secondary-flow loss effectively, and improve the performance of the turbine rotor blade row.

(5) In some embodiments, in the above turbine rotor blade row (1), the second cross-sectional shape has a flow-channel width which decreases monotonically and then stays constant from the inlet toward the outlet of the inter-blade flow channel.

Also with the above turbine rotor blade row (5), uplift of the secondary flow flowing outward in the radial direction from the surface of the hub can be suppressed by satisfying the above condition (A1/B1>A2/B2).

(6) In some embodiments, in the turbine rotor blade row according to any one of the above (1) to (5), each of the plurality of turbine rotor blades has a cross-sectional shape perpendicular to a blade-height direction which is constant from a blade root portion to a blade tip portion.

Even if each of the plurality of turbine blades is a parallel blade as in the above turbine blade row (6), the above described first cross-sectional shape and second cross-sectional shape are disposed at different positions from each other in the radial direction of the hub, and thus it is possible to form the turbine rotor blade row satisfying the above condition by taking advantage of the difference in perimeter. Accordingly, by employing parallel blades as the plurality of turbine rotor blades, it is possible to facilitate production (manufacture), improve performance, and reduce production costs for the turbine rotor blades.

(7) In some embodiments, in the turbine rotor blade row according to any one of the above (1) to (6), the first cross-sectional shape has a flow-channel width defined by a buildup portion formed by welding on at least one of the turbine rotor blade or the hub in at least one partial region in the axial direction of the hub.

With the above turbine rotor blade row (7), it is possible to improve the performance of the turbine rotor blade row, and to enhance the design flexibility of the airfoil of the turbine rotor blade.

(8) In some embodiments, in the above turbine rotor blade row (7), the throat portion of the first cross-sectional shape is disposed in the at least one partial region.

With the above turbine rotor blade row (8), it is possible to easily improve the performance of the turbine rotor blade row, and to enhance the design flexibility of the airfoil of the turbine rotor blade.

(9) In some embodiments, in the turbine rotor blade row according to any one of the above (1) to (8), H/W is less than 1.0 in each of the turbine rotor blades, where W is a blade width in the axial direction of the hub and H is a blade height in the radial direction of the hub.

With the above turbine rotor blade row (9), if the turbine rotor blade has a relatively low aspect ratio (if H/W is less than 1.0) and the shape of the inter-blade flow channel is determined simply without any conditions, interference is likely to take place between the secondary flow from the hub side and the secondary flow from the tip (blade tip) side. On the contrary, with the inter-blade flow channel formed to satisfy the above condition (A1/B1>A2/B2), it is possible to suppress such interference of secondary flows. Accordingly, it is possible to improve the performance of the turbine rotor blade row effectively.

(10) In some embodiments, in the turbine rotor blade row according to any one of the above (1) to (9), a blade-height ratio r1 at the first position and a blade-height ratio r2 at the second position satisfy expressions $0<r1<0.3$ and $0.3<r2<0.7$, respectively, where a blade-height ratio r is a value obtained by dividing a distance from a surface of the hub in the radial direction of the hub by a blade height of the turbine rotor blade in the radial direction of the hub.

With the above turbine rotor blade row (10), it is possible to suppress uplift of the secondary flow flowing outward in the radial direction from the surface of the hub effectively.

(11) A turbine stage according to at least one embodiment of the present invention comprises: the turbine rotor blade row according to any one of the above (1) to (10); and a turbine stator blade row disposed upstream of the turbine rotor blade row and including a plurality of turbine stator blades.

With the above turbine stage (11), it is possible to reduce secondary-flow loss, and improve the performance of the turbine rotor blade row effectively.

(12) An axial turbine according to at least one embodiment of the present invention comprises a plurality of turbine stages disposed in an axial direction of a hub, and at least one of the turbine stages is the turbine stage according to the above (11).

With the above axial-flow turbine (12), it is possible to reduce secondary-flow loss, and improve the performance of the axial-flow turbine effectively.

(13) In some embodiments, the axial turbine according to the above (12) is configured to operate with a degree of reaction being no more than 0.25 at the first position in the radial direction of the hub. In this case, the degree of reaction may be a negative value.

If the degree of reaction is small, the differential pressure before and after the inter-blade flow channel is also small, and thus the pressure gradient may reverse to generate a reverse flow in a region in the inter-blade flow channel. According to the researches by the present inventors, it was found that a characteristic flow (a swirl flow that moves from a region relatively close to the inlet and on the hub side of the inter-blade flow channel, toward the outer side of the hub in the radial direction in a spiral pattern accompanying a reverse flow) may be generated, typically if the degree of reaction is no more than 0.25. In this regard, with the inter-blade flow channel being formed to satisfy the above condition (A1/B1>A2/B2), it is possible to form a pressure gradient in the radial direction of the hub that suppresses uplift of the characteristic flow from the surface of the hub flowing outward in the radial direction of the hub. Accordingly, it is possible to reduce secondary-flow loss and improve the performance of the axial-flow turbine effectively.

(14) In some embodiments, the axial turbine according to the above (12) or (13) is configured to operate with a Mach number of a fluid being less than 1.0 in an entire region of the inter-blade flow channel.

Also in the axial-flow turbine configured to operate at a subsonic speed, with the inter-blade flow channel formed to satisfy the above condition (A1/B1>A2/B2), it is possible to reduce the secondary-flow loss and improve the performance of the turbine rotor blade row effectively.

Advantageous Effects

According to at least one embodiment of the present invention, provided is a turbine rotor blade row, a turbine stage, and an axial-flow turbine, whereby it is possible to suppress secondary-flow loss to improve performance of a turbine rotor blade row.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
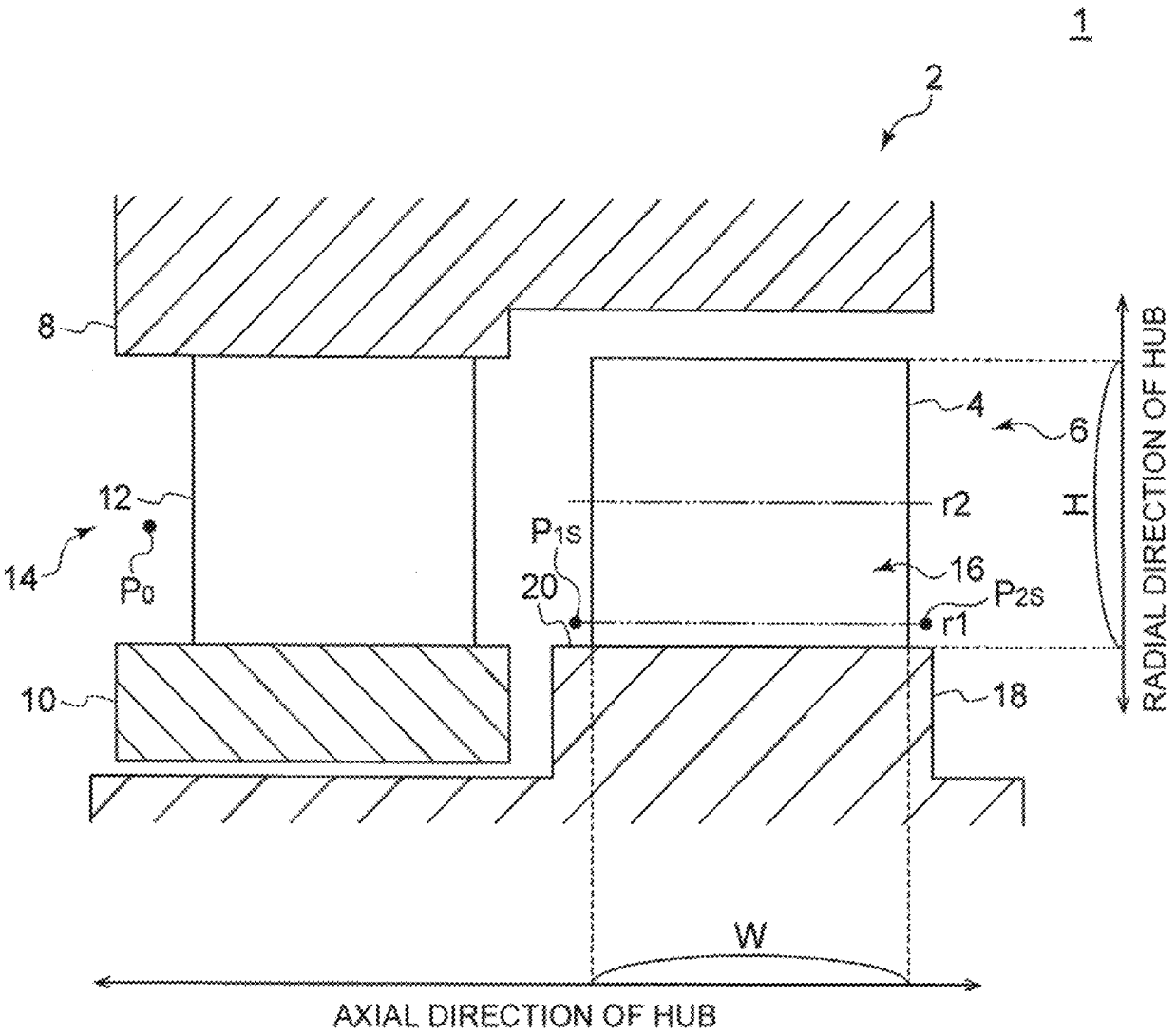
FIG. 1 is a schematic cross-sectional view of an axial-flow turbine according to some embodiments, showing a part of a cross section including an axis of a turbine rotor (meridional section).
Figure 2:
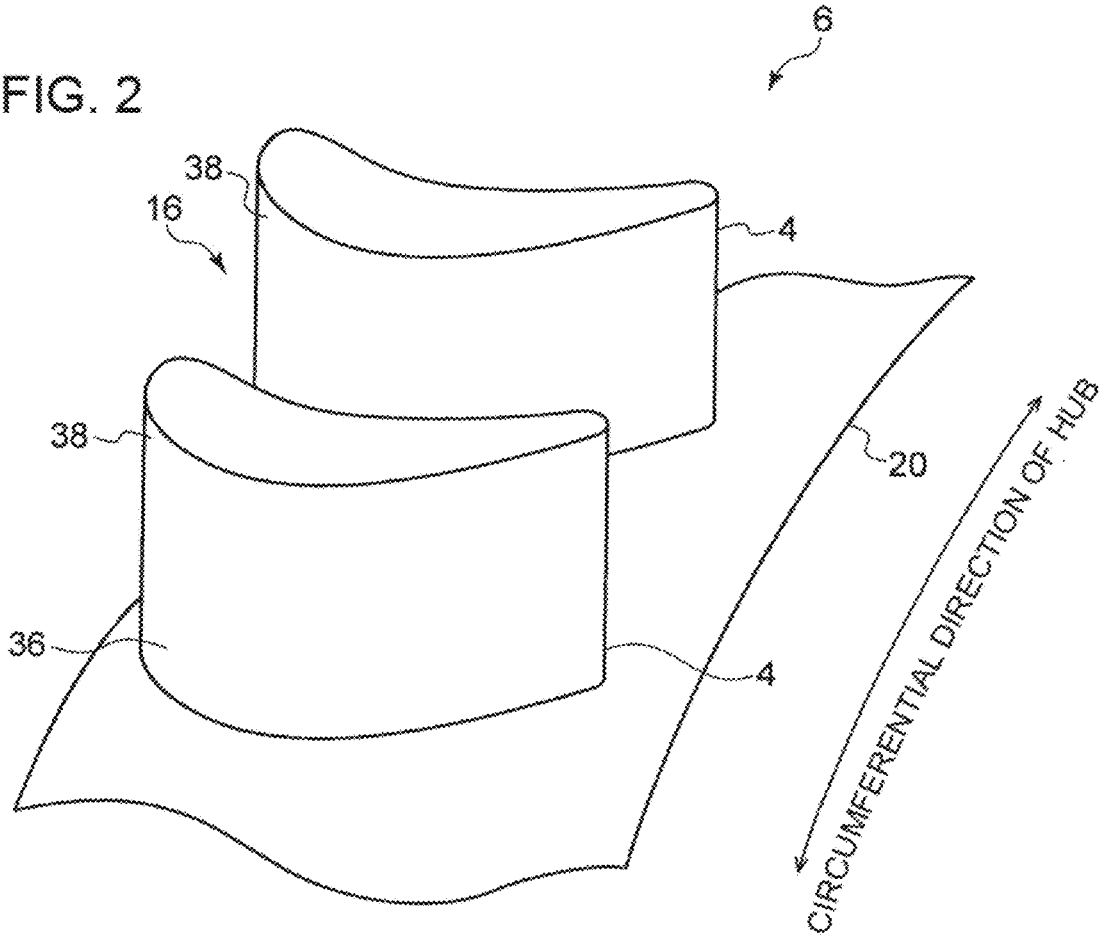
FIG. 2 is a schematic perspective view of a part of a turbine rotor blade row according to some embodiments.

FIG. 1 is a schematic cross-sectional view of an axial-flow turbine according to some embodiments, showing a part of a cross section including an axis of a turbine rotor (meridional section). FIG. 2 is a schematic perspective view of a part of a turbine rotor blade row according to some embodiments.

An axial-flow turbine 1 according to some embodiments includes a plurality of turbine stages 2 disposed in an axial direction of a hub 18. In FIG. 1, one of the turbine stages 2 is depicted in an enlarged view to simplify the description. Each turbine stage 2 includes a turbine rotor blade row 6 including a plurality of turbine rotor blades 4, and a turbine stator blade row 14 including a plurality of turbine stator blades 12 disposed between an outer ring 8 and an inner ring 10 and disposed upstream of the turbine rotor blade row 6. As depicted in FIG. 2, the plurality of turbine rotor blades 4 is disposed along a circumferential direction of the hub 18 (see FIG. 1) on a circumferential surface 20 of the hub 18, with inter-blade flow channels 16 formed between the turbine rotor blades 4.

According to Bernoulli's theorem, if there exists a region where the cross-sectional area of a flow channel (an area of a cross-section perpendicular to the main flow direction of the flow channel) increases from the inlet toward the outlet of the inter-blade flow channel, the pressure of the fluid increases and the velocity of the fluid decreases in the region, which is likely to result in occurrence of separation. Thus, a typical turbine rotor blade row is designed to have an inter-blade flow channel formed with a flow-channel width monotonically decreasing regardless of the position in the radial direction of the hub from the inlet toward the outlet of the inter-blade flow channel, for the purpose of suppressing separation.

In contrast, the inter-blade flow channel 16 described below has a cross-sectional shape that includes a throat portion between the inlet and the outlet of the inter-blade flow channel 16 in the axial direction of the hub 18, where the cross-sectional shape is taken in a direction perpendicular to the radial direction of the hub 18. The shape of the inter-blade flow channel 16 will be described below in detail.

The inter-blade flow channel 16 has the first cross-sectional shape at the first position r1 (see FIG. 1) in the radial direction of the hub 18 and the second cross-sectional shape at the second position r2 (see FIG. 1) farther from the hub 18 than the first position r1 is in the radial direction of the hub 18. The first and second cross-sectional shapes are taken in a direction perpendicular to the radial direction of the hub 18. Defining herein a value obtained by dividing the distance from the circumferential surface 20 of the hub 18 in the radial direction of the hub 18 by the blade height of the turbine rotor blade 4 in the radial direction of the hub 18 as "blade-height ratio", the blade-height ratio r1 at the first position that defines the first cross-sectional shape and the blade-height ratio r2 at the second position that defines the second cross-sectional shape described below satisfy relationships $0<r1<0.3$ and $0.3<r2<0.7$, respectively, for instance.

Figure 3:
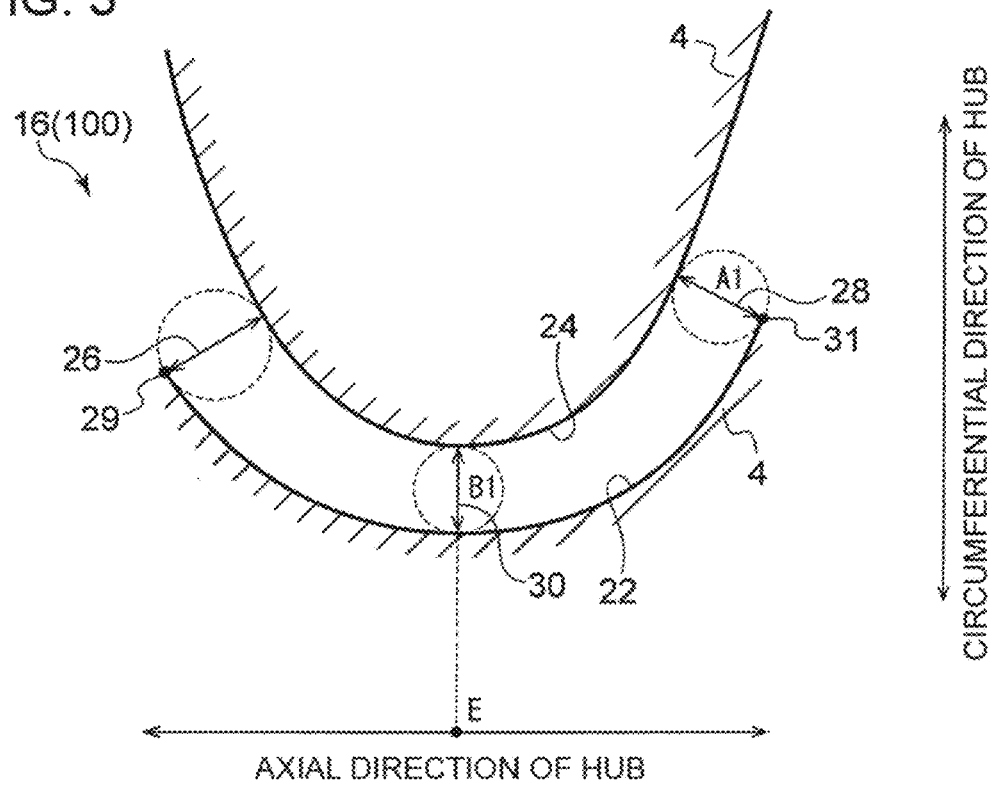
FIG. 3 is a schematic cross-sectional view of an example of the first cross-sectional shape according to some embodiments.
Figure 4:
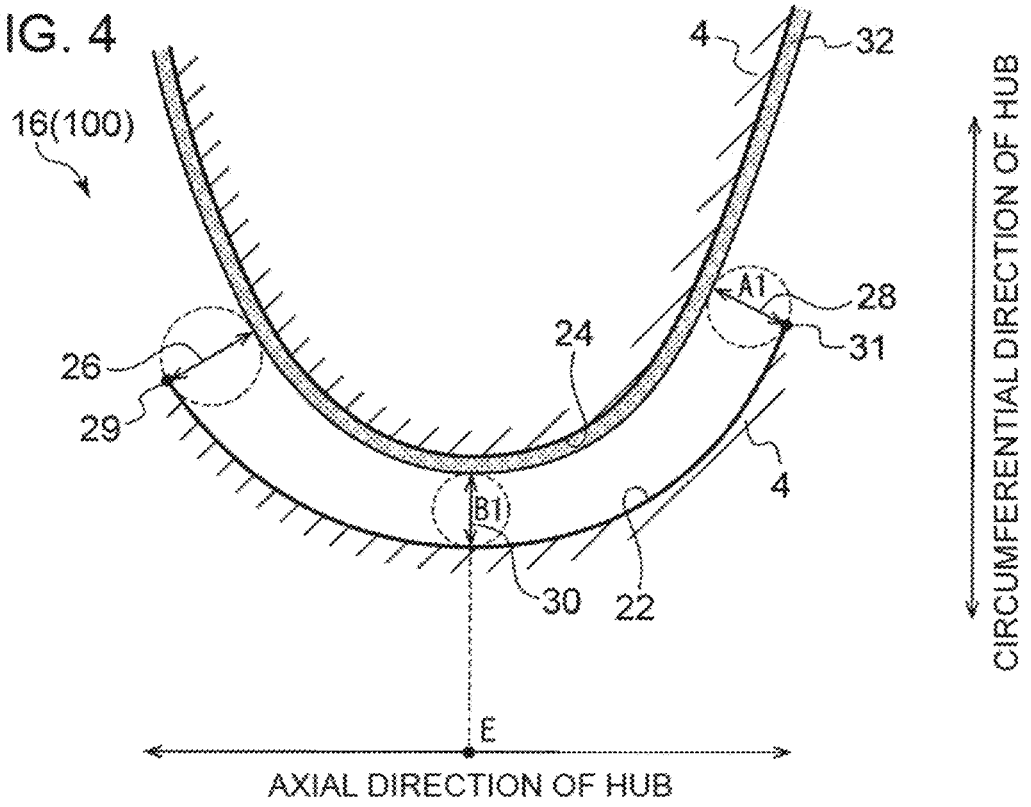
FIG. 4 is a schematic cross-sectional view of an example of the first cross-sectional shape according to some embodiments.
Figure 5:
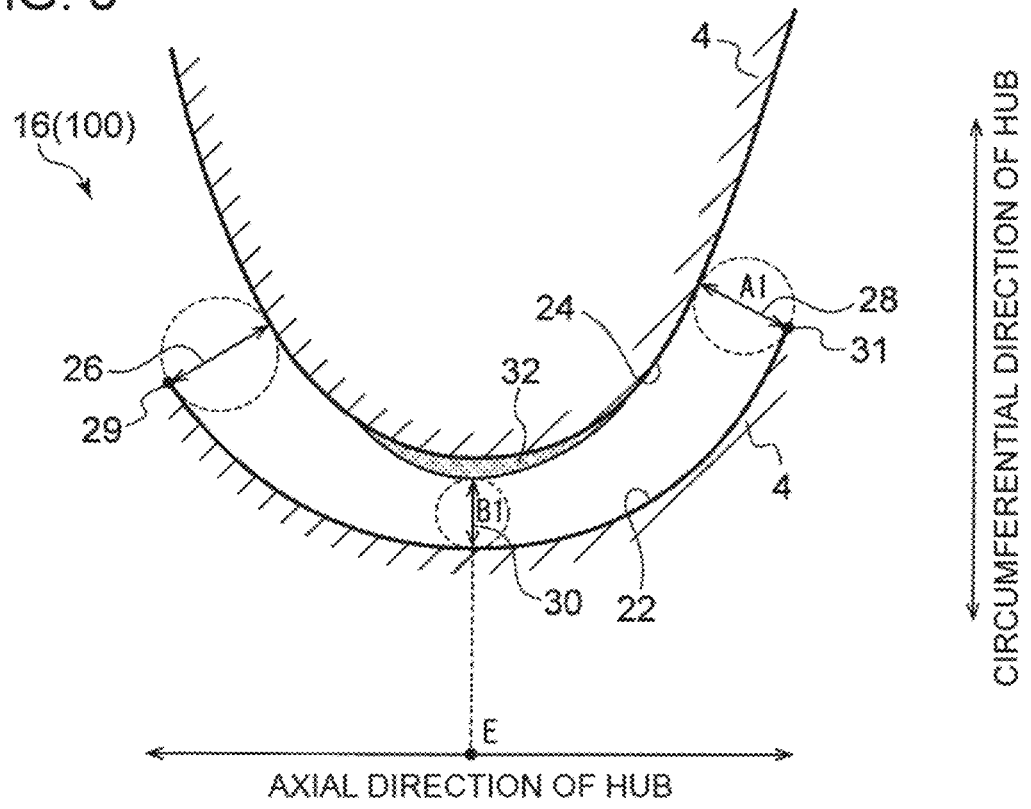
FIG. 5 is a schematic cross-sectional view of an example of the first cross-sectional shape according to some embodiments.
Figure 6:
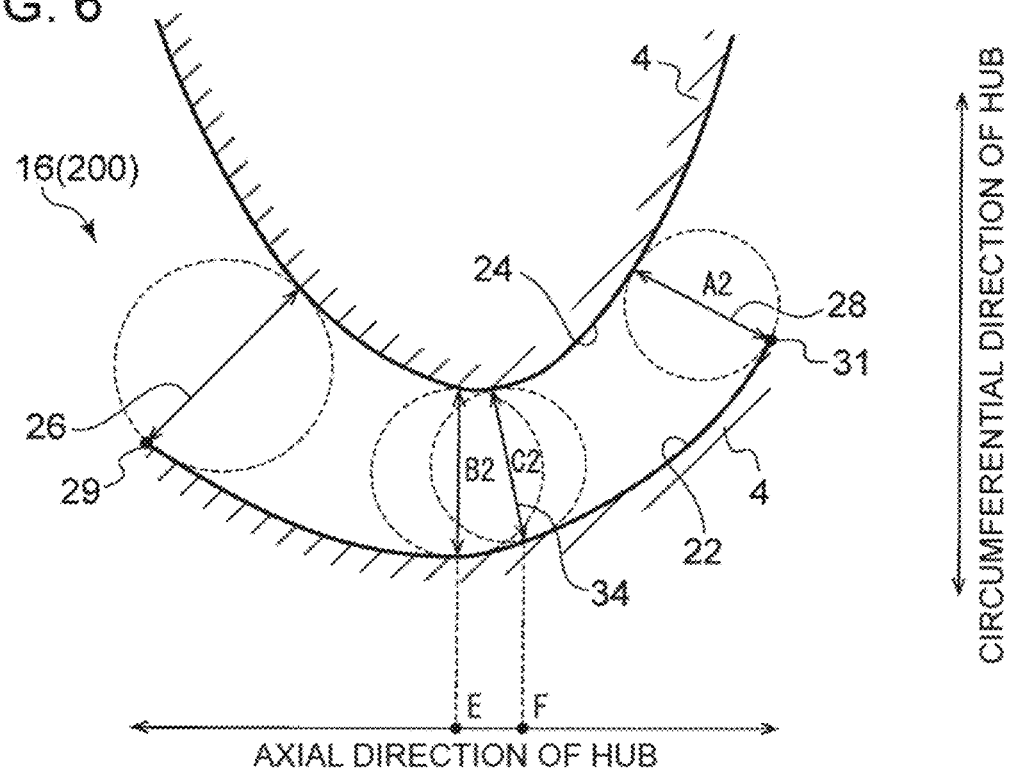
FIG. 6 is a schematic cross-sectional view of an example of the second cross-sectional shape according to some embodiments.
Figure 7:
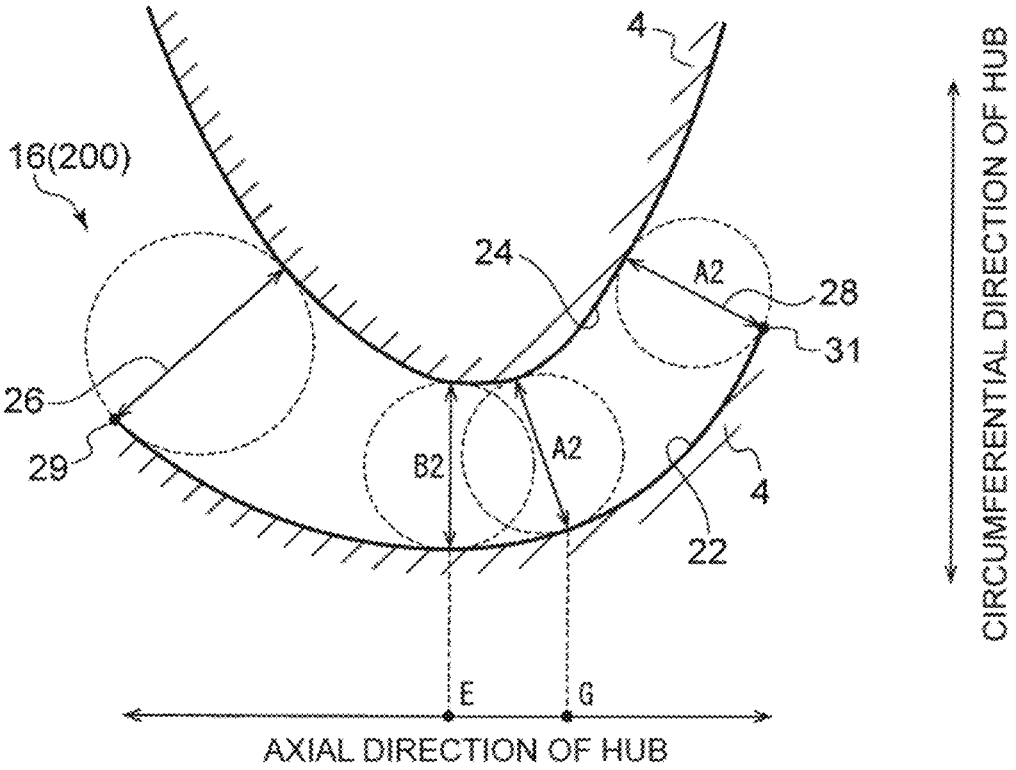
FIG. 7 is a schematic cross-sectional view of an example of the second cross-sectional shape according to some embodiments.
Figure 8:
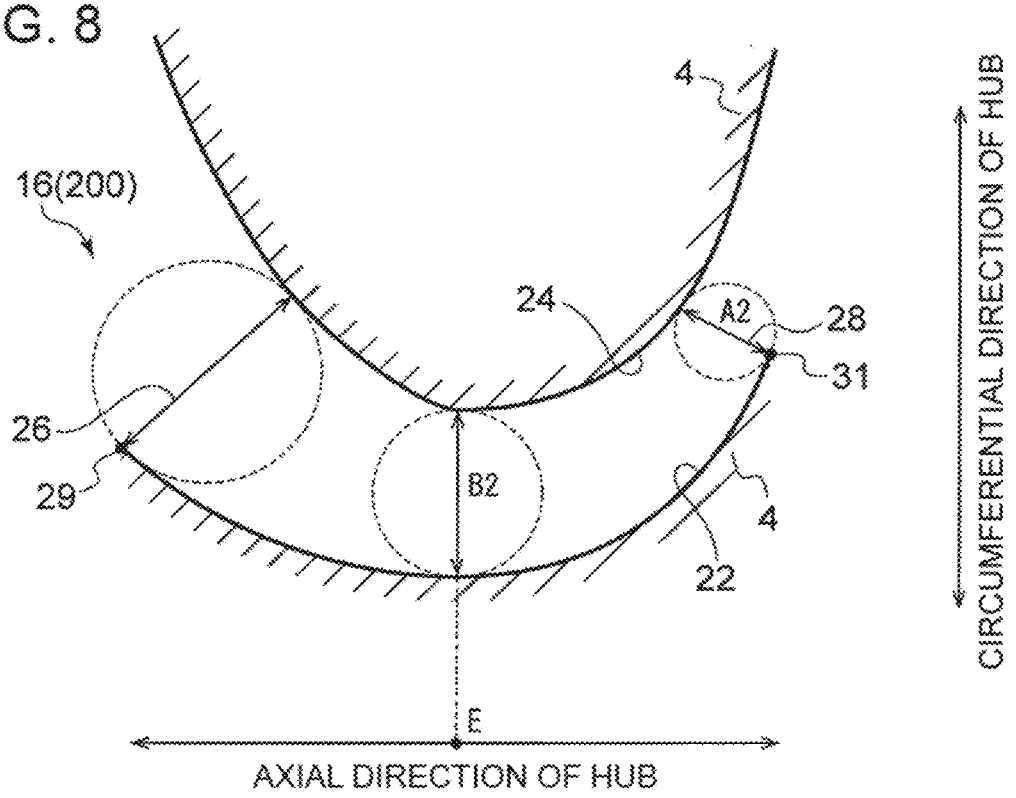
FIG. 8 is a schematic cross-sectional view of an example of the second cross-sectional shape according to some embodiments.

The first and second cross-sectional shapes will now be described with reference to FIGS. 3 to 8. FIGS. 3 to 5 are each a schematic cross-sectional view of an example of the first cross-sectional shape according to some embodiments. FIGS. 6 to 8 are each a schematic cross-sectional view of an example of the second cross-sectional shape according to some embodiments. In FIGS. 3 to 8, to explain the cross-sectional shape of the inter-blade flow channel 16, depicted are the pressure surface 22 of one of adjacent turbine rotor blades 4 and the suction surface 24 of the other one of the adjacent turbine rotor blades 4.

In some embodiments, as depicted in FIGS. 3 to 5 for instance, the first cross-sectional shape 100 has a throat portion 30 at the position E between the inlet 26 and the outlet 28 of the inter-blade flow channel 16 in the axial direction of the hub 18. Herein, "the inlet of the inter-blade flow channel" refers to a portion at the minimum distance represented by the diameter of a virtual inscribed circle touching the leading edge 29 of a turbine rotor blade 4 and the suction surface 24 of an adjacent turbine rotor blade 4, while "the outlet 28 of the inter-blade flow channel 16" refers to a portion at the minimum distance represented by the diameter of a virtual inscribed circle touching the trailing edge 31 of a turbine rotor blade 4 and the suction surface 24 of an adjacent turbine rotor blade 4. Furthermore, "the throat portion" refers to a portion at which the flow-channel width reaches its minimum, the flow-channel width represented by the diameter of a virtual inscribed circle touching the inter-blade flow channel 16 in the axial direction of the hub 18.

The inter-blade flow channel 16 is formed to satisfy an expression $A1/B1>A2/B2$, where A1 is the flow-channel width of the first cross-sectional shape 100 at the outlet 28 of the inter-blade flow channel 16. B1 is the flow-channel width of the first cross-sectional shape 100 at the throat portion 30, as depicted in FIGS. 3 to 5, and A2 is the flow-channel width of the second cross-sectional shape 200 at the outlet 28 of the inter-blade flow channel 16 and B2 is the flow-channel width of the second cross-sectional shape 200 at the same position E as the throat portion 30 in the axial direction of the hub 18, as depicted in FIGS. 6 to 8. In other words, the ratio A1/B1 of the flow-channel width A1 of the first cross-sectional shape 100 at the outlet 28 of the inter-blade flow channel 16 to the flow-channel width B1 of the first cross-sectional shape 100 at the throat portion 30 is greater than the ratio A2/B2 of the flow-channel width A2 of the second cross-sectional shape 200 at the outlet 28 of the inter-blade flow channel 16 to the flow-channel width B2 of the second cross-sectional shape 200 at the same position E as the throat portion 30 in the axial direction of the hub 18.

Figure 9:
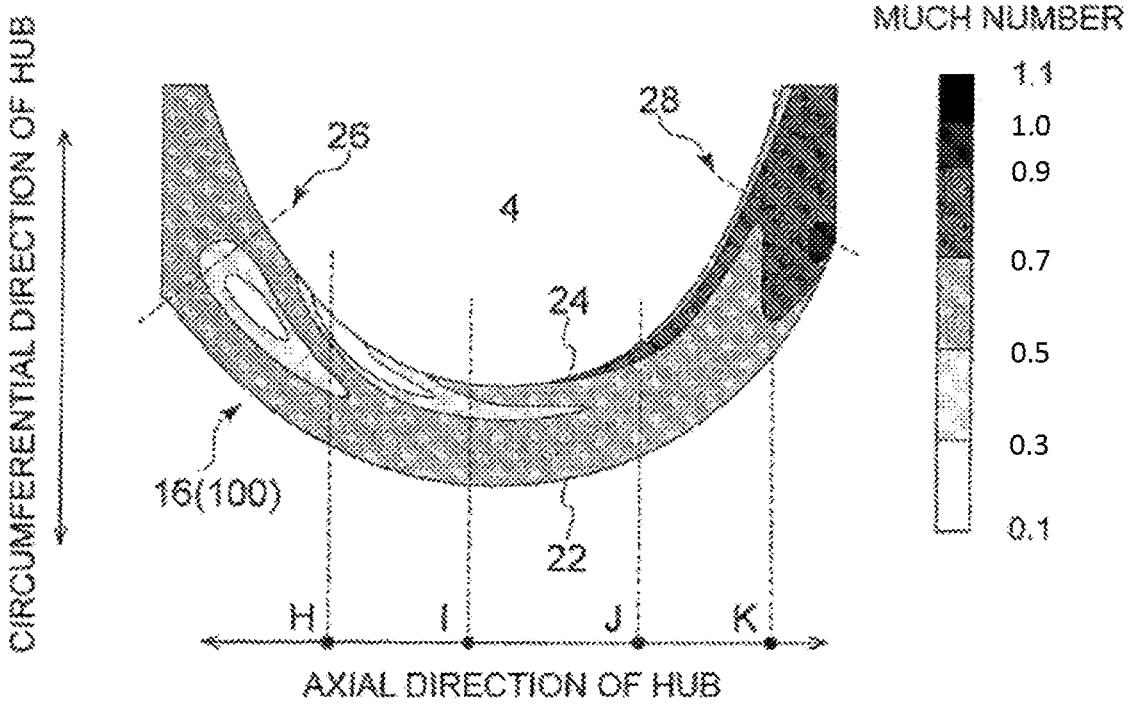
FIG. 9 is a diagram showing the first cross-sectional shape in an inter-blade flow channel satisfying A1/B1>A2/B2 along with an analysis result of the Mach number of a fluid at each position in the flow channel.
Figure 10:
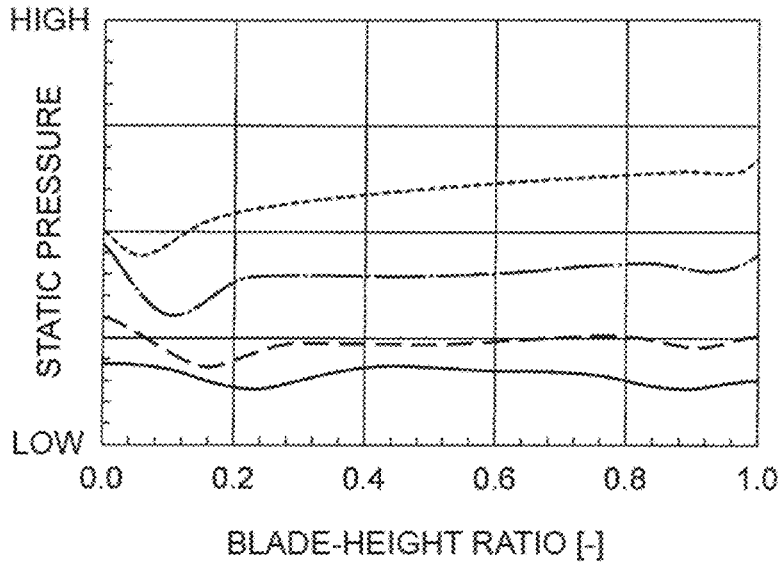
FIG. 10 is a chart of an analysis result on a relationship between a statistic pressure and a position in the blade-height direction, at each of the positions H, I, J, and K in the axial direction of a hub.

FIG. 9 is a diagram showing the first cross-sectional shape 100 in the inter-blade flow channel 16 satisfying the above condition ($A1/B1>A2/B2$), along with an analysis result of the Mach number of a fluid at each position in the flow channel. FIG. 10 is a chart of an analysis result on a relationship between a statistic pressure and a blade-height ratio, at each of the positions H, I, J, and K in the axial direction of the hub 18 depicted in FIG. 9. In FIG. 10, the dotted line, the single-dotted chain line, the dashed line, and the solid line represent analysis results at the positions H, I, J, and K in the axial direction, respectively.

As shown in FIG. 9, in the first cross-sectional shape 100, the Mach number of the fluid generally increases from the inlet 26 toward the outlet 28 of the inter-blade flow channel 16. Furthermore, as depicted in FIG. 10, in the inter-blade flow channel 16, the statistic pressure decreases from the inlet 26 toward the outlet 28 of the inter-blade flow channel 16 (in the order of the positions H, I, J, K in the axial direction of the hub 18), regardless of the blade-height ratio. Accordingly, even though the first cross-sectional shape 100 has the throat portion 30 between the inlet 26 and the outlet 28 of the inter-blade flow channel 16 (i.e., there exists a region where the flow-channel width increases from the throat portion 30 toward the downstream side), the inter-blade flow channel 16 functions properly as a velocity-increasing flow channel to suppress a secondary flow.

Figure 11A:
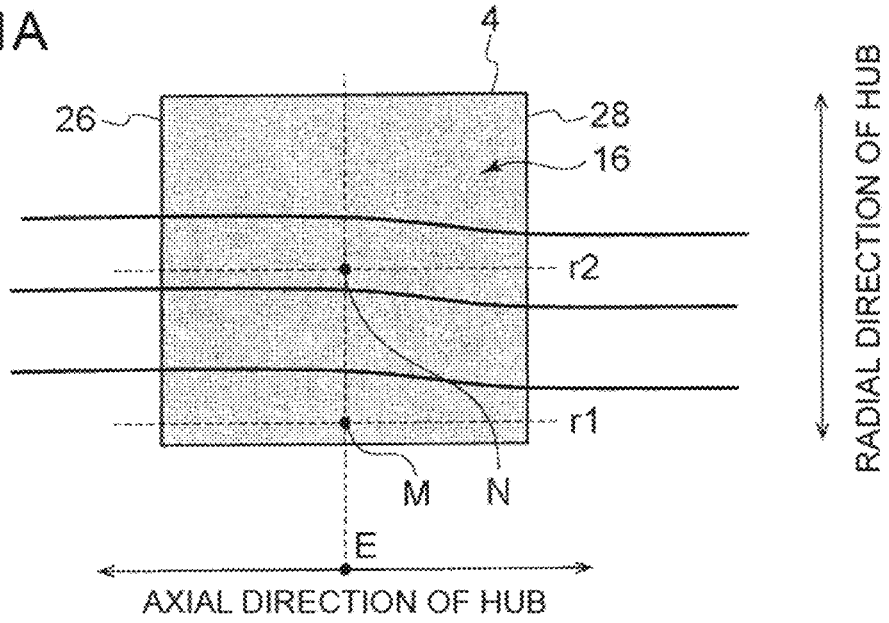
FIG. 11A is a schematic diagram of an analysis result on a limiting streamline at the pressure side of a rotor blade in an inter-blade flow channel that satisfies A1/B1>A2/B2.
Figure 11B:
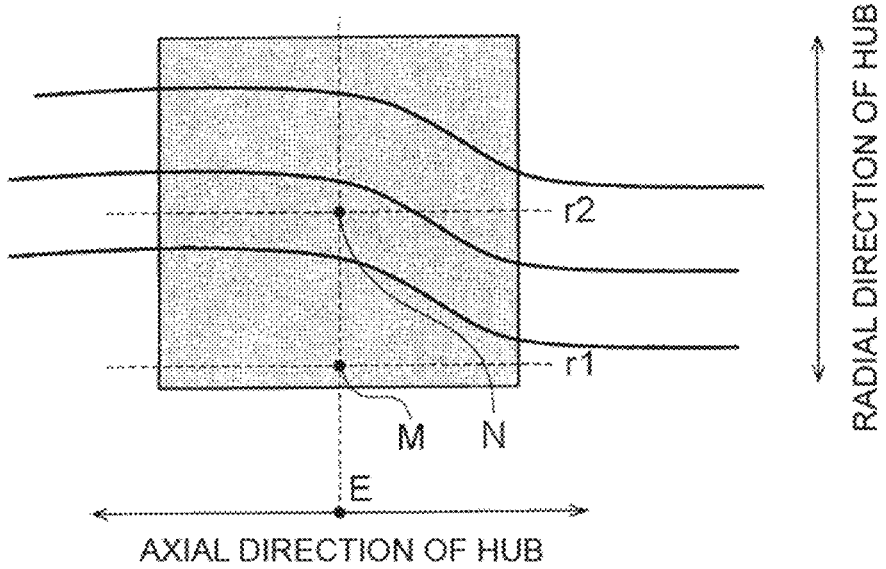
FIG. 11B is a schematic diagram of an analysis result on a limiting streamline at the pressure side of a rotor blade in a typical inter-blade flow channel.

The reasons why the above effect can be achieved will now be discussed with reference to FIGS. 1A and 11B. FIG. 11A is a schematic diagram of an analysis result on a limiting streamline (a streamline at a position infinitely close to the pressure surface 22 of the rotor blade 4) at the pressure side of the rotor blade in the inter-blade flow channel 16 satisfying the above condition ($A1/B1>A2/B2$). FIG. 11B is a schematic diagram of an analysis result on a limiting streamline at the pressure side of the rotor blade in the above described typical inter-blade flow channel. It should be noted that, a typical inter-blade flow channel is formed to have a flow-channel width that monotonically decreases from the inlet toward the outlet of the inter-blade flow channel in the cross-section at each position in the radial direction of the hub (the same applies hereinafter).

Comparing FIGS. 11A and 11B, the limit streamline of the inter-blade flow channel 16 shown in FIG. 11A is relatively close to a straight line along the axial direction of the hub. The reason is that, the inter-blade flow channel 16 satisfies the above condition ($A1/B1>A2/B2$), and thereby a pressure gradient in the radial direction of the hub inside the inter-blade flow channel 16 is in such a direction that suppresses a secondary flow as described below.

In the inter-blade flow channel 16 illustrated in FIG. 11A, M is a point on the position E in the axial direction of the hub and also on the position r1 in the radial direction of the hub (a point where the throat portion 30 is disposed), and N is a point on the position E in the axial direction of the hub and also on the position r2 in the radial direction of the hub. The pressure differential $\Delta P$ obtained by subtracting the pressure of the point M from the pressure of the point N in FIG. 11A is greater in the positive direction than the pressure differential $\Delta P$ obtained by subtracting the pressure of the point M from the pressure of the point N in the typical inter-blade flow channel shown in FIG. 11B. Accordingly, even if a secondary flow occurs on the surface of the hub, a positive increase in the pressure differential $\Delta P$ suppresses uplift of the secondary flow from the surface of the hub flpwing outward in the radial direction of the hub. This effect improves the performance of the turbine rotor blade row 6.

It should be noted that, although a typical inter-blade flow channel does not have the throat portion 30, the points in FIG. 11B are also referred to as points M, N to indicate the same positions as the points M, N in FIG. 11A, for the sake of convenience.

Furthermore, if the first cross-sectional shape 100 of the inter-blade flow channel 16 has the throat portion 30, the velocity of the fluid can be suitably increased at a position closer to the inlet 26 than the throat portion 30 is, and thereby it is possible to suppress occurrence of separation at a position closer to the inlet 26 than the throat portion 30 is. However, if such a throat portion 30 is simply provided without any conditions, the velocity may decrease in the flow channel at the outlet 28 side of the throat portion 30, which makes it difficult to suppress secondary-flow loss. In this regard, with the above condition A1/B1>A2/B2 being satisfied, it is possible to form a pressure gradient in the radial direction of the hub that suppresses uplift of the secondary flow from the surface of the hub flowing outward in the radial direction of the hub. Accordingly, it is possible to reduce the secondary-flow loss effectively and to improve the performance of the turbine rotor blade row while suppressing occurrence of separation at a position closer to the inlet 26 than the throat portion 30 is.

In some embodiments, with the first cross-sectional shape 100 depicted in FIGS. 4 and 5 for instance, at least one partial region in the axial direction of the hub 18 is defined by a buildup portion 32 formed by welding on at least one of the turbine rotor blade 4 or the hub 18. In this case, the throat portion 30 of the first cross-sectional shape 100 may be disposed in the at least one partial region. Accordingly, it is possible to improve the performance of the turbine rotor blade row 6, and to enhance the design flexibility of the airfoil of the turbine rotor blade 4.

The buildup portion 32 may be formed on the pressure surface 22 of one of adjacent two turbine rotor blades 4, or on the suction surface 24 of the other one of the turbine rotor blades 4. Furthermore, the buildup portion 32 may be formed over the entire region from the inlet 26 to the outlet 28 in the axial direction of the hub as depicted in FIG. 4, or partially in the axial direction of the hub as depicted in FIG. 5.

The second cross-sectional shape according to an embodiment may include a throat portion 34 between the inlet 26 and the outlet 28, as depicted in FIG. 6 for instance. As described above, also in a case where the first cross-sectional shape 100 and the second cross-sectional shape 200 have the respective throat portions 30, 34, uplift of the secondary flow outward in the radial direction of the hub 18 can be suppressed by satisfying the above condition (A1/B1>A2/B2).

Furthermore, in this case, the throat portion 34 of the second cross-sectional shape 200 may be disposed closer to the outlet 28 of the inter-blade flow channel 16 in the axial direction of the hub 18 than the throat portion 30 of the first cross-sectional shape 100 is. In other words, in the axial direction of the hub 18, the position F of the throat portion 34 may be disposed closer to the outlet 28 than the position E of the throat portion 30 is. In this way, the above-described differential pressure ΔP can be increased in the positive direction more easily at the position E where the throat portion 30 is disposed in the axial direction of the hub 18, and thereby uplift of the secondary flow from the surface of the hub flowing outward in the radial direction is effectively suppressed.

In an embodiment, the second cross-sectional shape 200, depicted in FIG. 7 for instance, may have a flow-channel width that monotonically decreases and then stays constant from the inlet 26 toward the outlet 28. Also with this shape, the inter-blade flow channel 16 satisfies the above condition (A1/B1>A2/B2), which suppresses uplift of the secondary flow outward in the radial direction of the hub 18.

Specifically, as for the second cross-sectional shape depicted in FIG. 7, the flow-channel width monotonically decreases to the position G closer to the outlet 28 than the position E in the axial direction of the hub 18, and then is maintained at A2. In this way, the above-described differential pressure ΔP can be increased in the positive direction more easily at the position E where the throat portion 30 is disposed in the axial direction of the hub 18, and thereby uplift of the secondary flow from the surface of the hub flowing outward in the radial direction is effectively suppressed. Accordingly, it is possible to improve the performance of the turbine rotor blade row 6 effectively.

In an embodiment, the second cross-sectional shape 200, depicted in FIG. 8 for instance, may have a flow-channel width that monotonically decreases from the inlet 26 toward the outlet 28. In this way, the above-described differential pressure ΔP can be increased in the positive direction more easily at the position E where the throat portion 30 is disposed in the axial direction of the hub, and thereby uplift of the secondary flow from the surface of the hub flowing outward in the radial direction is effectively suppressed.

In some embodiments, each of the turbine rotor blades 4, depicted in FIGS. 1 to 8 for instance, may have a constant cross-sectional shape (cross-sectional profile) perpendicular to the blade-height direction from the blade-root portion 36 (see FIG. 2) to the blade tip portion 38 (see FIG. 2). In other words, each of the plurality of turbine rotor blades 4 may be a parallel blade (two-dimensional blades).

Even if each of the plurality of turbine rotor blades 4 is a parallel blade, the above described first cross-sectional shape 100 and second cross-sectional shape 200 are disposed at different positions from each other in the radial direction of the hub, and thus it is possible to form the turbine rotor blade row 6 satisfying the above condition (A1/B1>A2/B2) by taking advantage of the difference in perimeter. Accordingly, by employing parallel blades as the plurality of turbine rotor blades 4, it is possible to facilitate production (manufacture), improve performance, and reduce production costs for the turbine rotor blades 4.

Furthermore, the smaller the degree of reaction (a ratio of the heat drop in a turbine rotor blade to the heat drop in a turbine stage) is, the more the secondary flow is likely to occur. In this regard, the present inventors found that a characteristic swirl may occur typically if the degree of reaction is no more than 0.25. In the present specification, a degree of reaction is a value defined as follows.

$$\text{Degree of reaction}=(P_{1S}-P_{2S})/(P_0-P_{2S})$$

In the above expression, $P_{1S}$, $P_{2S}$, $P_0$ are each a static pressure or a total pressure at the corresponding position depicted in FIG. 1. Specifically, $P_{1S}$ is a static pressure at the inlet of the rotor blade at the first position r1 in the radial direction of the hub, $P_{2S}$ is a static pressure at the outlet of the rotor blade at the first position r1 in the radial direction of the hub, and $P_0$ is a total pressure at the inlet of the stator blade.

Figure 12:
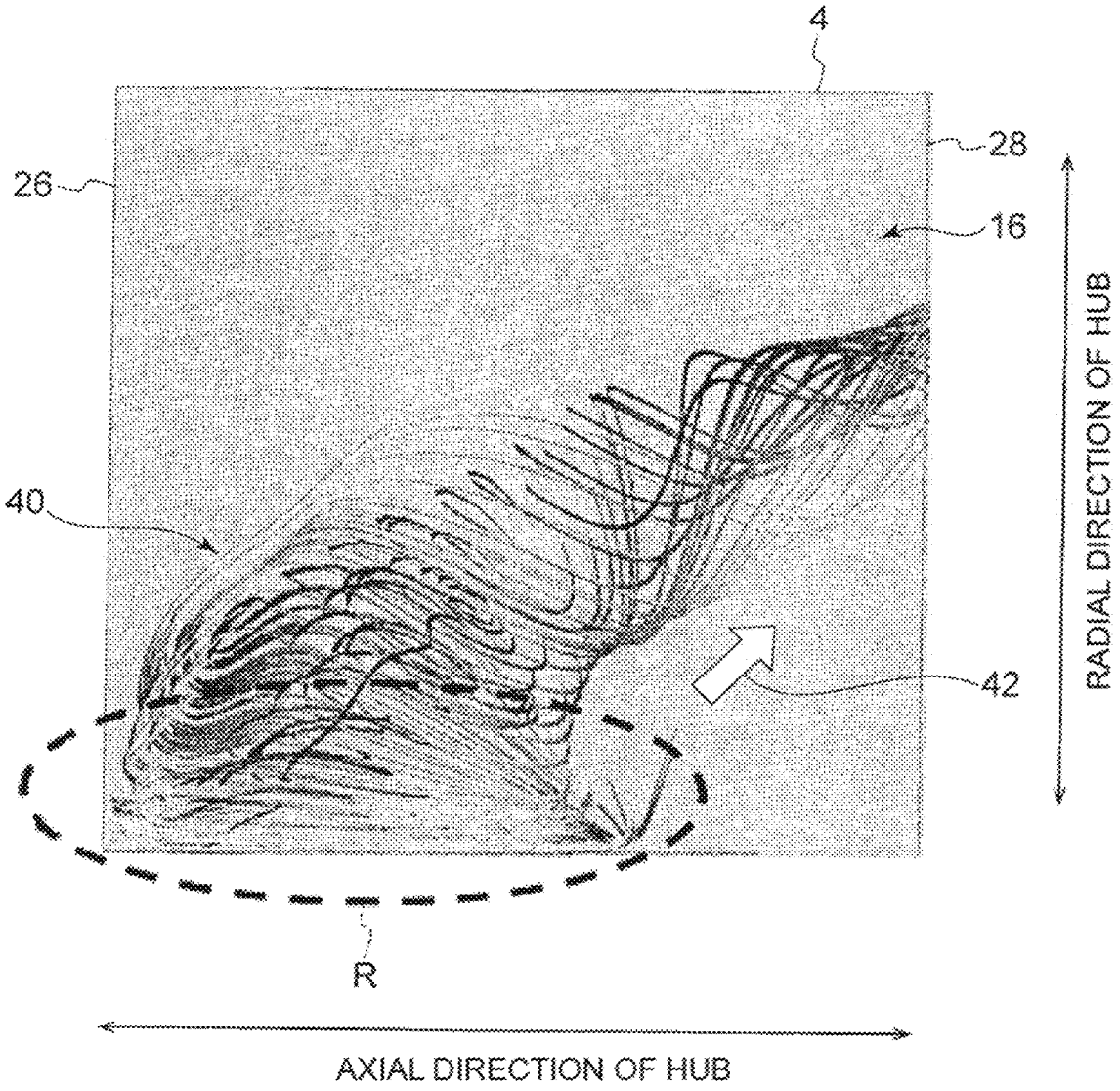
FIG. 12 is a diagram of a characteristic swirl that develops inside an inter-blade flow channel.

In FIG. 12, depicted is a characteristic swirl 40 that occurs in the inter-blade flow channel 16 in a meridional cross-section of the inter-blade flow channel. As shown in FIG. 12, the swirl 40 moves from a region R on the hub side of the inter-blade flow channel 16, the region R being relatively close to the inlet 26, outwardly in the radial direction of the hub (in the direction of the arrow 42) in a spiral pattern, accompanied by a reverse flow.

If the degree of reaction is small, the differential pressure before and after the inter-blade flow channel 16 is also small, and thus the pressure gradient may reverse to generate a reverse flow in a region in the inter-blade flow channel. Thus, typically if the degree of reaction is no more than 0.25, the characteristic swirl 40 is likely to occur as described above.

In this regard, in the inter-blade flow channel 16 formed to satisfy the above condition (A1/B1>A2/B2), the differential pressure ΔP in the radial direction of the hub increases in the positive direction inside the inter-blade flow channel 16 as compared to the typical inter-blade flow channel, as described above with reference to FIGS. 11A and 11B, and thus uplift of the characteristic swirl 40 from the surface of the hub flowing outward in the radial direction of the hub can also be suppressed. Accordingly, it is possible to improve the performance of the turbine rotor blade row 6 effectively.

In some embodiments, the axial-flow turbine 1 depicted in FIG. 1 for instance may be configured to operate with the Mach number of a fluid in the entire region of the inter-blade flow channel 16 being less than 1.0. Also in such an axial-flow turbine configured to operate at a subsonic speed, the performance of the turbine rotor blade row 6 can be improved effectively by the inter-blade flow channel 16 formed to satisfy the above condition (A1/B1>A2/B2).

In some embodiments, for each of the turbine rotor blades 4 depicted in FIGS. 1 to 8 for instance, a ratio H/W of the blade height H (see FIG. 1) in the radial direction of the hub to the blade width W (see FIG. 1) in the axial direction of the hub may be less than 1.0.

If the turbine rotor blade 4 has a relatively low aspect ratio (if H/W is less than 1.0) and the shape of the inter-blade flow channel 16 is determined simply without any conditions, interference may take place between the above described swirl 40 (see FIG. 12) from the hub side and the secondary flow at the tip side, and loss is likely to be generated. On the contrary, with the inter-blade flow channel 16 formed to satisfy the above condition (A1/B1>A2/B2), it is possible to suppress such interference between the swirl 40 and the secondary flow at the tip side. Accordingly, it is possible to improve the performance of the turbine rotor blade row 6 effectively.

In some embodiments, for each of the turbine rotor blades 4 depicted in FIGS. 1 to 8 for instance, the aspect ratio (H/W) may be greater than 1.0.

The degree of reaction has a distribution in the radial direction, which is higher at the tip side and lower at the hub side. Thus, if the aspect ratio is greater than 1.0, a secondary flow and separation are likely to occur at the hub side. In this regard, with the inter-blade flow channel 16 formed to satisfy the above condition (A1/B1>A2/B2), it is possible to suppress occurrence of a secondary flow and separation, and to improve the performance of the turbine rotor blade row 6 effectively.

Figure 13A:
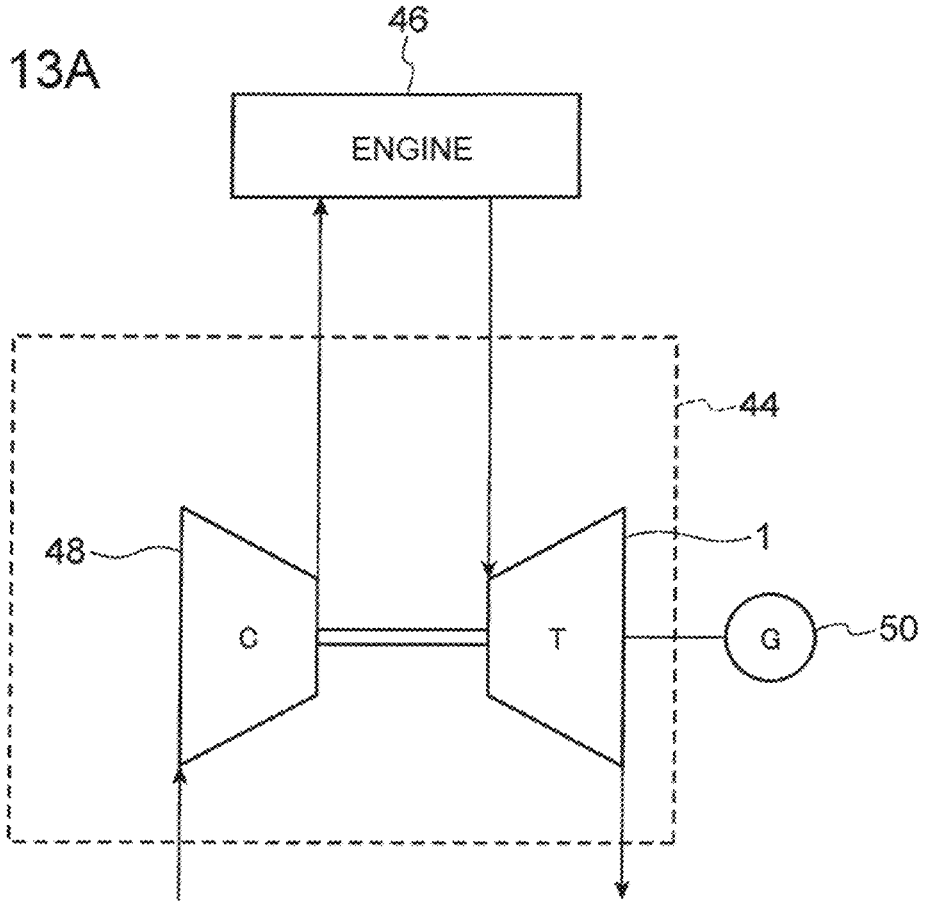
FIG. 13A is a diagram of an exemplary configuration where an axial-flow turbine is applied to a turbine of a turbocharger.

In some embodiments, as depicted in FIG. 13A, the axial-flow turbine 1 (see FIG. 1) may be applied to a turbocharger 44, for instance. More specifically, the turbine rotor blade row 6 including a plurality of turbine rotor blades 4 forming the above described inter-blade flow channel 16 may be applied to a turbine 1 for driving a compressor 48 for pressurizing intake air to be fed to an internal combustion engine 46. In this case, the axial-flow turbine 1 is driven by exhaust gas from the internal combustion engine 46 to generate power, which drives the compressor 48. The axial-flow turbine 1 may be further coupled to a generator 50.

In a machine that has load fluctuation (flow-rate fluctuation) like the turbocharger 44 of the internal combustion engine 46, an inflow angle of a fluid with respect to the rotor blade changes, and thus it is difficult to suppress a secondary flow and separation in the inter-blade flow channel. On the other hand, with the inter-blade flow channel 16 formed to satisfy the above condition (A1/B1>A2/B2) applied, it is possible to suppress a secondary flow and separation in the inter-blade flow channel even if the inflow angle changes. Thus, it is possible to suppress a secondary flow and separation effectively regardless of load fluctuation, and thereby the robust characteristic improves.

While the axial-flow turbine 1 in the embodiment depicted in FIG. 1 is of the Rateau type in which a turbine stage 2 includes a single turbine stator blade row 14 and a single turbine rotor blade row 6, the number of turbine stator blade rows 14 and the number of turbine rotor blade rows 6 in a single turbine stage 2 are not particularly limited. For instance, the axial-flow turbine 1 may be of the Curtis type in which a turbine stage 2 includes a single turbine stator blade row 14 and two turbine rotor blade rows 6 (or, two turbine stator blade rows 14 and three turbine rotor blade rows 6).

Figure 13B:
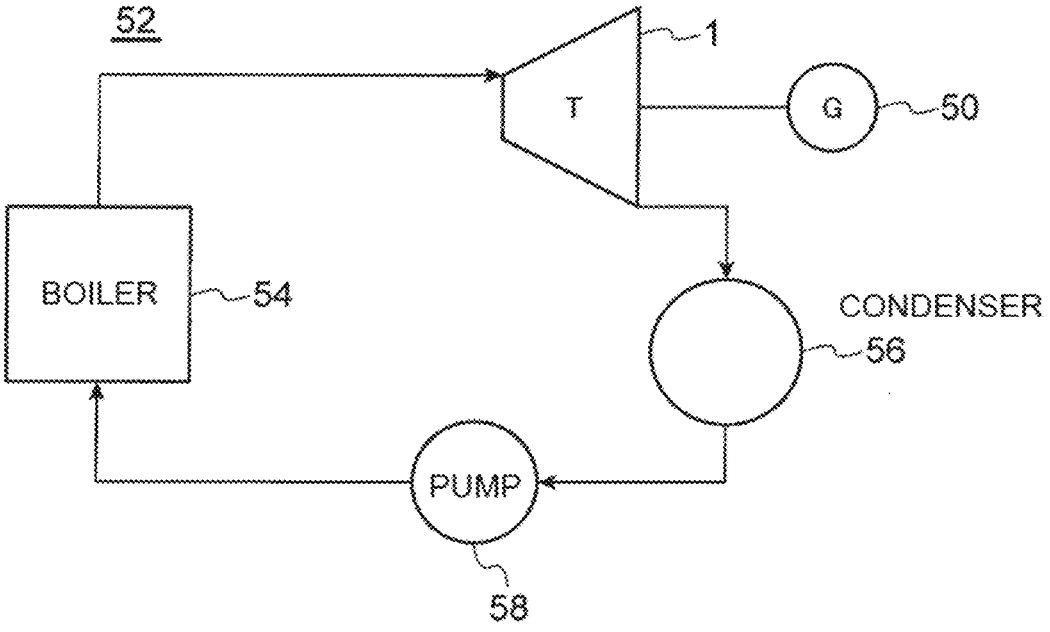
FIG. 13B is a diagram of an exemplary configuration where an axial-flow turbine is applied to a turbine of a power-generating facility.

Furthermore, the axial-flow turbine 1 depicted in FIG. 1 may be a steam turbine, or a gas turbine. For instance, as depicted in FIG. 13B, the axial-flow turbine may be applied to a steam turbine in a power-generation facility 52. The power-generation facility 52 depicted in FIG. 13B includes a boiler 54 for generating steam, a steam turbine 1 driven by steam generated by the boiler 54, a generator 50 coupled to the steam turbine 1, a condenser 56 for cooling and condensing exhaust gas from the steam turbine 1, and a pump 58 for supplying the boiler 54 with water generated through condensation by the condenser 56. Furthermore, application of the axial-flow turbine 1 is not particularly limited, and may be a turbine in a ship, or a fixed turbine for private power generation.

Embodiments of the present invention were described in detail above, but the present invention is not limited thereto, and various amendments and modifications may be implemented

DESCRIPTION OF REFERENCE NUMERAL

1 Axial-flow turbine
2 Turbine stage
4 Turbine rotor blade
6 Turbine rotor blade row
8 Outer ring
10 Inner ring
12 Turbine stator blade
14 Turbine stator blade row
16 Inter-blade flow channel
18 Hub
20 Circumferential surface
22 Pressure surface
24 Suction surface
26 Inlet
28 Outlet
29 Leading edge
30 Throat portion
31 Trailing edge
32 Buildup portion
34 Throat portion
36 Blade root portion
38 Blade tip portion
40 Swirl
42 Arrow
44 Turbocharger
46 Internal combustion engine
48 Compressor
50 Generator
52 Power-generation facility
54 Boiler
56 Condenser

58 Pump
100 First cross-sectional shape
200 Second cross-sectional shape

The invention claimed is:

1. A turbine rotor blade row, comprising:

a plurality of discrete turbine rotor blades disposed along a circumferential direction of a hub, each discrete turbine rotor blade of the plurality of discrete turbine rotor blades comprising an airfoil extending from a root portion to a tip portion, and an inter-blade flow channel formed between the airfoils of adjacent discrete turbine rotor blades, wherein the inter-blade flow channel has a first cross-sectional shape perpendicular to a radial direction of the hub at a first position in the radial direction, and a second cross-sectional shape perpendicular to the radial direction of the hub at a second position farther from the hub than the first position in the radial direction, wherein the first cross-sectional shape has a throat portion after an inlet and before an outlet of the inter-blade flow channel in an axial direction of the hub, and wherein an expression A1/B1>A2/B2 is satisfied, where A1 is a flow-channel width of the first cross-sectional shape at the outlet of the inter-blade flow channel, B1 is a flow-channel width of the first cross-sectional shape at the throat portion, A2 is a flow-channel width of the second cross-sectional shape at the outlet of the inter-blade flow channel, and B2 is a flow-channel width of the second cross-sectional shape at the same position as the throat portion in the axial direction of the hub.

2. The turbine rotor blade row according to claim 1, wherein the flow-channel width of the second cross-sectional shape monotonically decreases from the inlet toward the outlet of the inter-blade flow channel.

3. The turbine rotor blade row according to claim 1, wherein the second cross-sectional shape includes a throat portion between the inlet and the outlet of the inter-blade flow channel.

4. The turbine rotor blade row according to claim 3, wherein the throat portion of the second cross-sectional shape is disposed closer to the outlet of the inter-blade flow channel in the axial direction of the hub than the throat portion of the first cross-sectional shape is.

5. The turbine rotor blade row according to claim 1, wherein the second cross-sectional shape has a flow-channel width which decreases monotonically and then stays constant from the inlet toward the outlet of the inter-blade flow channel.

6. The turbine rotor blade row according to claim 1, wherein the first cross-sectional shape has a flow-channel width defined by a buildup portion formed by welding on at least one of the turbine rotor blade or the hub in at least one partial region in the axial direction of the hub.

7. The turbine rotor blade row according to claim 6, wherein the throat portion of the first cross-sectional shape is disposed in the at least one partial region.

8. The turbine rotor blade row according to claim 1, wherein H/W is less than 1.0 in each of the turbine rotor blades, where W is a blade width in the axial direction of the hub and H is a blade height in the radial direction of the hub.

9. The turbine rotor blade row according to claim 1, wherein a blade-height ratio r1 at the first position and a blade-height ratio r2 at the second position satisfy expressions $0<r1<0.3$ and $0.3<r2<0.7$, respectively, where a blade-height ratio r is a value obtained by dividing a distance from a surface of the hub in the radial direction of the hub by a blade height of the turbine rotor blade in the radial direction of the hub.

10. A turbine stage comprising:

the turbine rotor blade row according to claim 1; and a turbine stator blade row disposed upstream of the turbine rotor blade row and including a plurality of turbine stator blades.

11. An axial turbine comprising a plurality of turbine stages disposed in an axial direction of a hub, wherein at least one of the turbine stages is the turbine stage according to claim 10.

12. The axial turbine according to claim 11 configured to operate with a degree of reaction being no more than 0.25 at the first position in the radial direction of the hub.

13. The axial turbine according to claim 11 configured to operate with a Mach number of a fluid being less than 0.7 from the inlet to a mid-point of the inter-blade flow channel in an axial direction of the hub.

* * * * *